US006778796B2

(12) United States Patent
Maeshima et al.

(10) Patent No.: US 6,778,796 B2
(45) Date of Patent: Aug. 17, 2004

(54) DRIVING MECHANISM FOR USE IN IMAGE FORMING APPARATUS

(75) Inventors: Masanobu Maeshima, Kawachinagano (JP); Naoki Yamane, Matsubara (JP); Masahiro Tsutsumi, Daito (JP); Eiji Nimura, Tondabayashi (JP); Nariaki Tanaka, Osakasayama (JP); Akira Matayoshi, Habikino (JP); Koshiro Tomimori, Yamatokoriyama (JP)

(73) Assignees: Kyocera Mita Corporation, Osaka (JP); Kyocera Corporation, Kyoto (JP)

( * ) Notice: Subject to any disclaimer, the term of this patent is extended or adjusted under 35 U.S.C. 154(b) by 0 days.

(21) Appl. No.: 10/328,551

(22) Filed: Dec. 23, 2002

(65) Prior Publication Data

US 2003/0123904 A1 Jul. 3, 2003

(30) Foreign Application Priority Data

Dec. 27, 2001 (JP) ..... 2001-396798

(51) Int. Cl.[7] ..... G03G 15/00
(52) U.S. Cl. ..... 399/167
(58) Field of Search ..... 399/90, 107, 110, 399/111, 159, 167

(56) References Cited

U.S. PATENT DOCUMENTS 6,400,914 B1 * 6/2002 Noda et al. ..... 399/90

* cited by examiner

*Primary Examiner*—Hoang Ngo
(74) *Attorney, Agent, or Firm*—Jordan and Hamburg LLP

(57) ABSTRACT

A driving mechanism for use in an image forming apparatus has a rotary shaft, a driving joint, a drum gear, a cleaning roller gear, and a transfer roller gear. The rotary shaft extends through a photosensitive member along an axis of rotation of the photosensitive member. The rotary shaft is rotatably supported at the opposite axial end parts thereof by bearings, respectively. The rotary shaft is un-rotatably jointed to the photosensitive member relative thereto at a lateral side part of a rear end part of the rotary shaft corresponding to the rear side of the image forming apparatus. The driving joint is jointed to the rear end part of the rotary shaft protruding from the photosensitive member at the rear side of the image forming apparatus to input a rotating force of a drum motor to the photosensitive drum. The drum gear is provided at the rear side of the photosensitive member. The cleaning roller gear and the transfer roller gear are in mesh with the drum gear. The rotary shaft has a mass larger than the photosensitive member.

20 Claims, 7 Drawing Sheets

DRIVING MECHANISM FOR USE IN IMAGE FORMING APPARATUS

BACKGROUND OF THE INVENTION

1. Field of the Invention

This invention relates to a driving mechanism for use in an image forming apparatus for driving a photosensitive member and a rotary member provided in the vicinity of the photosensitive member.

2. Description of the Related Art

Heretofore, known is a driving mechanism 200 for use in an image forming apparatus, as shown in FIG. 7. Such a conventional driving mechanism 200 drives, by means of a drum driving motor, a photosensitive drum 4 and rotary members provided in the vicinity of the photosensitive drum 4, such as a cleaning roller 160 for removing toner residuals from the surface of the photosensitive drum 4 and a transfer roller 11 for transferring a toner image formed on the drum surface to a copy sheet. The drum driving motor is interconnected with a rear end part 41*a*' of the rotary shaft 41' via a driving joint 50' connected to the drum motor. Thus, the driving force of the drum motor (not shown) is transmitted to the photosensitive drum 4 by means of a rotary shaft 41' extending through the photosensitive drum 4, with the rotary shaft 41' rotating with the driving joint 50'. The rear end 41*a*' of the rotary shaft 41' is a part of the rotary shaft 41' provided at the rear side of the image forming apparatus and has a projection 41*c*' extending radially outwardly. The driving joint 50' is coupled to the rotary shaft 41' with the driving joint 50' covering the rear end part 41*a*' including the projection 41*c*'.

The driving force of the drum motor is transmitted from the photosensitive drum 4 to the cleaning roller 160 and to the transfer roller 11 by means of a drum gear 43 provided at an axial end of the photosensitive drum 4 and meshing with a cleaning roller gear 161 provided at an axial end of the cleaning roller 160 as well as with a transfer roller gear 111 provided at an axial end of the transfer roller 11, thereby rotating the cleaning roller 160 and the transfer roller 11 along with the photosensitive drum 4. The drum gear 43, the cleaning roller gear 161, and the transfer roller gear 111 are located on the front side of the image forming apparatus and respectively co-rotatably coupled with or attached to the photosensitive drum 4 and the rollers 11 and 16. Furthermore, the rotary shaft 41' is co-rotatably coupled with the photosensitive drum 4 with a front end part 41*b*' of the rotary shaft 41' being fitted in a hole formed in the axially front end part of the photosensitive drum 4. The front end part 41*b*' has a generally D-shape in cross section or its equivalent and is at the axially front end thereof, the hole has a cross-sectional shape to match with the cross-sectional shape of the front end part 41*b*'.

The rotary shaft 41' may be inserted into a hollow portion of the photosensitive drum 4 with the front end part 41*b*' of the rotary shaft 41' being inserted to the hollow portion from the rear side of the image forming apparatus (from the left side in FIG. 7). When the rotary shaft 41' is fully inserted, its front end 41*b* project out of the photosensitive drum 4, with the rear end 41*a*' having the projection 41*c*' being located at the rear side to oppose the driving joint 50'. The rotary shaft 41' and the photosensitive drum 4 are co-rotatably coupled with each other at the front side of the image forming apparatus where the drum gear 43 is in mesh with the cleaning roller gear 161 and the transfer roller gear 111.

Since the rotary shaft 41' and the photosensitive drum 4 are coupled with each other on the front side of the image forming apparatus at a portion of the front end part 41*b*', the driving force is transmitted through substantially the entire length of the rotary shaft 41' from the rear end part 41*a*' of the rotary shaft 41' (rear side of the image forming apparatus) at which the rotary shaft 41' is jointed to the driving joint 50', to the front end part 41*b*' of the rotary shaft 41' (front side of the image forming apparatus) at which the rotary shaft 41' is jointed to the photosensitive drum 4. Then, the driving force of the drum motor is transmitted to the cleaning roller 160 and the transfer roller 11.

Thus, before the driving force of the drum motor is transmitted to the transfer roller 11 and the cleaning roller 160, the driving force is required to be transmitted from the one axial end of the photosensitive drum to the other axial end thereof where a load is applied. Accordingly, it is highly likely that torsional stress may be caused in the rotary shaft 41' due to a torque necessary for the rotary shaft 41' to rotate the photosensitive drum 4, the cleaning roller gear 161 and the transfer roller gear 111, during the transmission of the driving force to the cleaning roller gear 161 and the transfer roller gear 111. As a result, the rotational speed of the photosensitive drum 4 may fluctuate.

SUMMARY OF THE INVENTION

In view of the above, it is an object of this invention to provide a driving mechanism for use in an image forming apparatus which operates stably.

It is another object of the present invention to provide a driving mechanism which drives a photosensitive drum of an image forming apparatus without fluctuation of rotating speed.

It is still another object of the present invention to provide a driving mechanism which is free from the torsional stress in the driving mechanism.

It is further object of the present invention to provide a driving device for stably driving a photosensitive drum and its related one or more rollers of an image forming apparatus.

It is still further object of the present invention to provide an image forming apparatus including a fixture attaining one or more of the objects as mentioned above.

According to an aspect of this invention, a driving mechanism for use in an image forming apparatus drives a photosensitive member of a substantially cylindrical shape and a rotary member provided in the vicinity of the photosensitive member, the driving member is to be interconnected with a driving motor to be driven thereby. The driving mechanism comprises a rotary shaft extending through the photosensitive member in a longitudinal direction of the photosensitive member and protruding from the photosensitive member at its opposite ends, the rotary shaft being journaled at its axially opposite ends by bearings, and being co-rotatably coupled with the photosensitive member at one of the axially opposite ends thereof, the rotary shaft having a mass larger than that of the photosensitive member; a driving force transmission member which is jointed to the rotary shaft protruding from the photosensitive member at the one of the axial opposite ends, to transmit a driving force of the driving motor to the rotary shaft; a photosensitive member gear provided at the one of the axial opposite ends of the photosensitive member to co-rotate with the photosensitive member; and a rotary member gear provided at the one of the axial opposite ends of the rotary member, the rotary member gear being in mesh with the photosensitive member gear to be driven thereby.

In the above arrangement, the photosensitive member and the rotary shaft are coupled with each other at the side where the photosensitive member gear is in mesh with the rotary member gear and at the lateral side part of the axial end part of the rotary shaft where the rotary shaft is coupled to the photosensitive drum to allow the rotating force of the drum motor to be transmitted via the rotating force transmission member to the photosensitive member. This arrangement shortens a transmission route for the rotating force to be transmitted from the photosensitive member to the rotary member, and thus makes the transmission route shorter than the transmission route of the conventional driving mechanism.

This arrangement dispenses with the mechanism for transmitting the rotating force from one axial end of the rotary shaft and the photosensitive drum to the other axial end thereof before the rotating force is transmitted to the rotary member, as in the case of the conventional structure. Therefore, there is no likelihood that torsional stress may be caused in the rotary shaft during the transmission of the rotating force to the rotary member. Further, since the rotary shaft has the mass larger than the photosensitive member, fluctuation in the rotation of the photosensitive member is effectively eliminated or suppressed, thereby ensuring stable operation of the photosensitive drum and desirable image formation.

These and other objects, features and advantages of the present invention will become more apparent upon a reading of the following detailed description and accompanying drawing.

DESCRIPTION OF THE PREFERRED EMBODIMENTS

Figure 1:
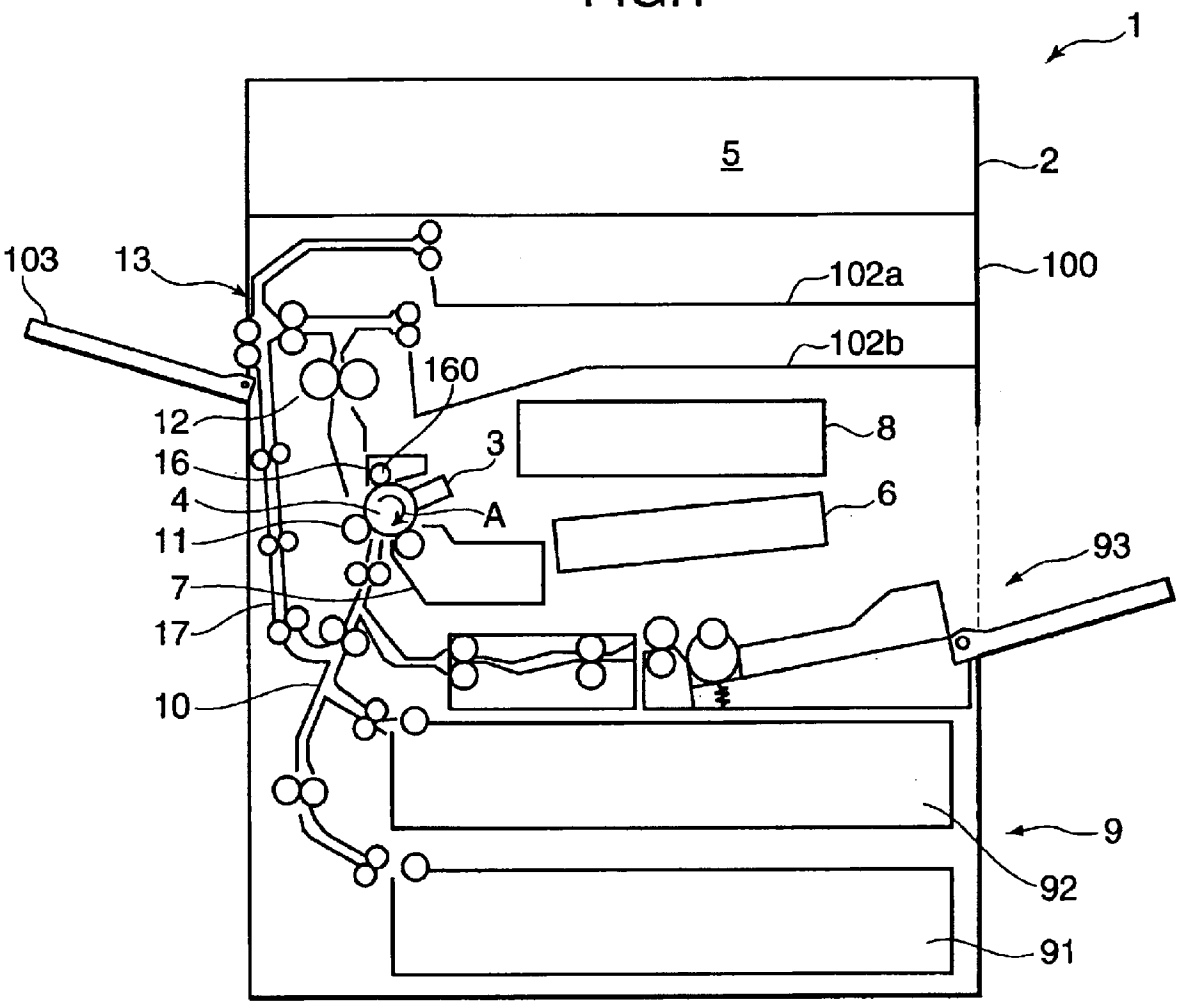
FIG. 1 is a schematic illustration of an image forming apparatus provided with a driving mechanism in accordance with an embodiment of this invention.

A driving mechanism for use in an image forming apparatus in accordance with an embodiment of this invention is described with reference to the accompanying drawings. FIG. 1 schematically illustrates an entire arrangement of a copier 1 as an example of an image forming apparatus equipped with the driving mechanism according to the embodiment of the present embodiment.

Referring to FIG. 1, in a main body 2 of the copier 1, a photosensitive drum 4 is rotated in the direction of arrow A, and is uniformly charged by a charger 3 on its surface. A document reader 5 reads the image of original document, and a laser beam bearing the data of the read image is emitted from an exposure unit 6 and irradiates the surface of the photosensitive drum 4 to form an electrostatic latent image on the surface of the photosensitive drum 4. A developing agent such as toner supplied from a toner container 8 is adhered to the latent image by a developing unit 7 to develop a toner image from the latent image.

A copy sheet is discharged from a copy sheet storage section 9 and is transported via a sheet transport path 10 to the photosensitive drum 4 bearing the toner image on the surface thereof. The toner image is transferred onto the copy sheet from the surface of the drum 4 while the copy sheet is being transported through between the drum 4 and a transfer roller 11 with the transfer roller 11 pressing the copy sheet against the surface of the drum 4.

After the transfer of the toner image, the copy sheet is separated from the drum surface, and is transported to a fixing unit 12 which includes a pair of fixing rollers for image fixation. After the image is fixed on the copy sheet at the fixing unit 12, the copy sheet is transported to a sheet transport path 13 which has a plurality of branch routes. The copy sheet transported to a junction of the plurality of branch routes of the sheet transport path 13 is directed to a specified branch route by a sheet transport route selecting member. For single-side image formation, the copy sheet is discharged onto one of an upper tray 102*a*, a lower tray 102*b*, and a sheet tray 103 of a sheet discharge section 100. For double-side image formation, the copy sheet transported to the junction of the sheet transport path 13 is fed to a sheet transport path 17 for an opposite or the other side image formation and is finally discharged onto one of the trays 102*a*, 102*b*, and 103 of the sheet discharge section 100 after the double-side image formation.

Reference numeral 16 denotes a cleaning unit. The cleaning unit 16 includes a cleaning roller 160 provided with a cleaning blade (not shown) for scraping off toner residues on the surface of the photosensitive drum 4. The copy sheet storage section 9 is detachably attached to the copier main body 2, and includes sheet cassettes 91 and 92 each adapted for storing copy sheets of a predetermined size therein, and a bypass stacker (bypass tray) 93 arranged above the sheet cassette 92. The sheet cassettes 91 and 92, and the bypass tray 93 are communicated, by the sheet transport path 10, with an image forming assembly including the photosensitive drum 3 and the developer 7.

Now, the driving mechanism according to the embodiment of this invention will be described with reference to FIG. 2. Primary features of the embodiment according to this invention reside in the structure of the driving mechanism for rotating the photosensitive drum 4, the transfer roller 11, and the cleaning roller 160 in the copier 1, and more specifically, in the driving mechanism having such a construction as to transmit a rotating force of a drum motor (not shown) to the transfer roller 11 and the cleaning roller 160 via the photosensitive drum 4 through a short route for rotating force transmission.

Figure 2:
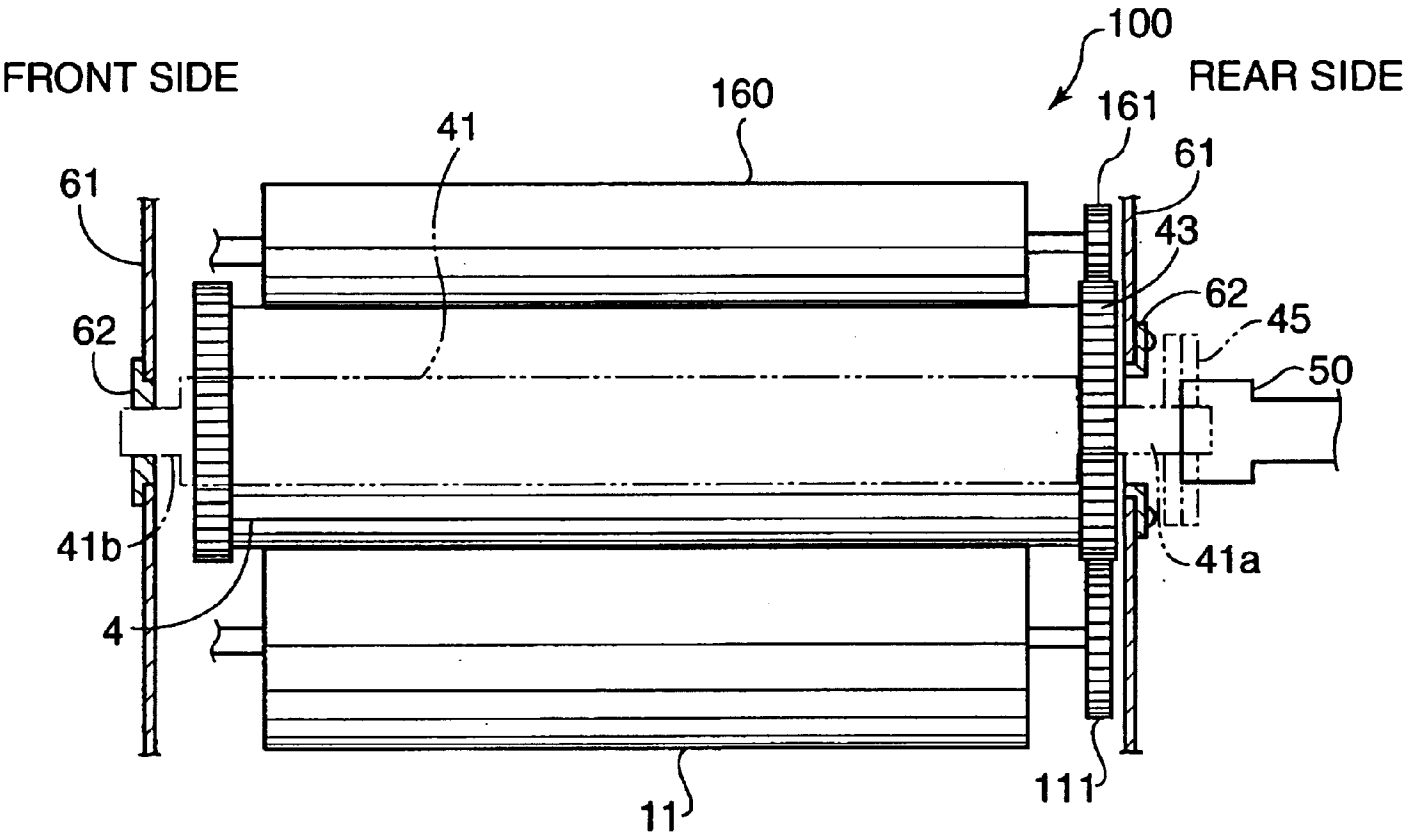
FIG. 2 is a partial plan view showing a construction of the driving mechanism.

FIG. 2 is a partial elevational view showing an example of the driving mechanism for rotating the photosensitive drum 4, the transfer roller 11, and the cleaning roller 160. For the convenience of illustration in FIG. 2, a rotary shaft 41 extending through the photosensitive drum 4 is indicated by two-dotted chain lines. The driving mechanism 100 for rotating the photosensitive drum 4, the transfer roller 11, and the cleaning roller 160 includes the rotary shaft 41 extending through the photosensitive drum 4, a coupling member 45 mounted on the rotary shaft 41, a driving joint 50, a drum gear (photosensitive member gear) 43 mounted at an axially end portion of the drum 4, a transfer roller gear 111 provided on an axially end side of the transfer roller 11, and a cleaning roller gear 161 provided on an axially end side of the cleaning roller 160. The driving joint 50 is coupled with the rotary shaft 41 by the coupling member 45 to input a rotating force of a drum motor (not shown) to the photosensitive drum 4.

The driving joint 50 is directly connected to the drum motor as a driving source, for transmitting a rotating force of the drum motor to various parts of the driving mechanism. The driving joint 50 is coupled with an axially end of the rotary shaft 41 of the photosensitive drum 4 in such a manner that the driving joint 50 co-rotate with the rotary shaft 41. As the rotary shaft 41 is rotated along with the driving joint 50, the photosensitive drum 4 is rotated. The drum gear 43 of the photosensitive drum 4 meshes the cleaning roller gear 161 and the transfer roller gear 111. As the photosensitive drum 4 is rotated, the cleaning roller 160 and the transfer roller 11 are correspondingly rotated by the driving of the drum gear 43, the cleaning roller gear 161, and the transfer roller gear 111.

The rotary shaft 41 is inserted into and extend through an axially extending central portion of a hollow inside of the cylindrical photosensitive drum 4. Specifically, the rotary shaft 41 extends through the drum 4 in such a manner that its axially opposite end parts 41*a* and 41*b* protrude out of the drum 4. The opposite end parts 41*a* and 41*b* of the rotary shaft 41 are journaled by bearings 62 and 62, respectively. The bearings 62 and 62 are each fixedly attached to a corresponding frame member 61 of a photosensitive drum assembly 60. As shown in FIG. 2, the rotary shaft 41 of the driving mechanism 100 has a larger diameter than the rotary shaft 41' of the conventional driving mechanism 200 shown in FIG. 7 to increase the mass of the rotary shaft. The results of experiments as to how the mass of the rotary shaft affects image formation are shown in Table 1. Table 1 shows that when the ratio of the mass of the rotary shaft to that of the photosensitive drum is 1.0 or more, desirable image formation is executable.

TABLE 1

| Ratio of Mass (rotary shaft/drum) | image formation status |
|---|---|
| 0.5 | X (jitter appeared) |
| 0.8 | Δ (jitter appeared slightly) |
| 1.0 | ○ |
| 1.5 | ○ |

The part 41*a* of the rotary shaft 41 which protrudes out of the photosensitive drum 4 at the rear side of the copier 1 is hereinafter called as "rear end part 41*a*", whereas the end part 41*b* which protrudes out of the photosensitive drum at the front side of the copier 1 is hereinafter called as "front end part 41*b*". The coupling member 45 provided on the rear end part 41*a* is larger in cross section than the rotary shaft 41. As mentioned above, the driving joint 50 is jointed to the coupling member 45 to transmit the rotating force of the drum motor to the rotary shaft 41. The coupling member 45 is prepared independently of the rotary shaft 41, and is mounted on the rotary shaft 41. The insertion and assembling of the rotary shaft 41 into the photosensitive drum 4 is carried out before the coupling member 45 is mounted on the rotary shaft 41. After the rotary shaft 41 is inserted into the hollow portion of the photosensitive drum 4 from the front side of the copier 1, i.e. in the rightward direction in FIG. 2, and the rear end part 41*a* of the rotary shaft 41 projecting from the rear end portion of the photosensitive drum 4 is journaled on the rear-side bearing 62, and then, the coupling member 45 is mounted on the rotary shaft 41.

The rotary shaft 41 is interconnected with the photosensitive drum 4 at the rear end part 41*a*, namely, at the rear side of the copier 1 where the drum gear 43 is in mesh with the cleaning roller gear 161 and the transfer roller gear 111. As shown in FIG. 2, the rear end part 41*a* of the rotary shaft 41 at which the rotary shaft 41 is rotatably supported or journaled on the bearing 62 and is jointed to the photosensitive drum 4 is smaller in cross section than the remaining part of the rotary shaft 41. As an example, the rear end part 41*a* has such a shape in cross section which is obtained by cutting away a part or opposing parts of a circle. The rear end part 41*a* can take any contour in cross section so far as the rotary shaft 41 is rotatably supported by the bearings 62. When the rotary shaft 41 is inserted in the hollow portion of the photosensitive drum 4 from the front side of the copier 1, the rear end part 41*a* is fitted in a hole 4*a* (described later in detail) that is formed in the rear end portion of the photosensitive drum 4 with the rear end plane of the remaining part of the rotary shaft 41 abutting against the inner end wall of the photosensitive drum 4. This arrangement facilitates axial positioning of the rotary shaft 41 relative to the photosensitive drum 4.

Figure 3:
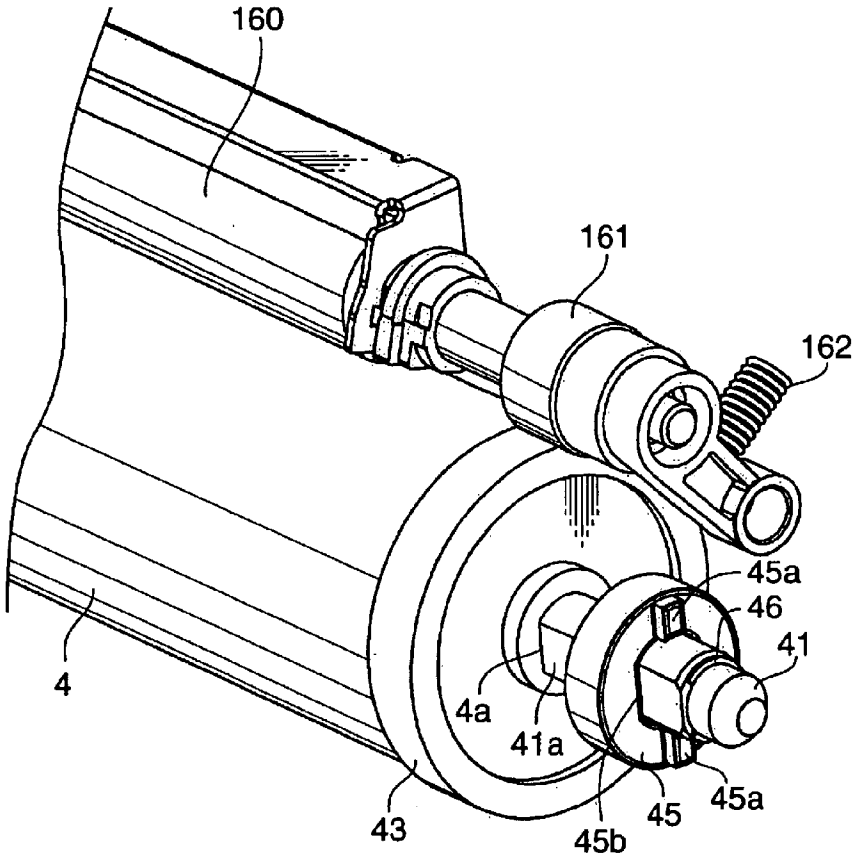
FIG. 3 is a partial perspective view showing a state that a coupling member is mounted on an axial end of a rotary shaft for a photosensitive drum of the image forming apparatus.
Figure 4:
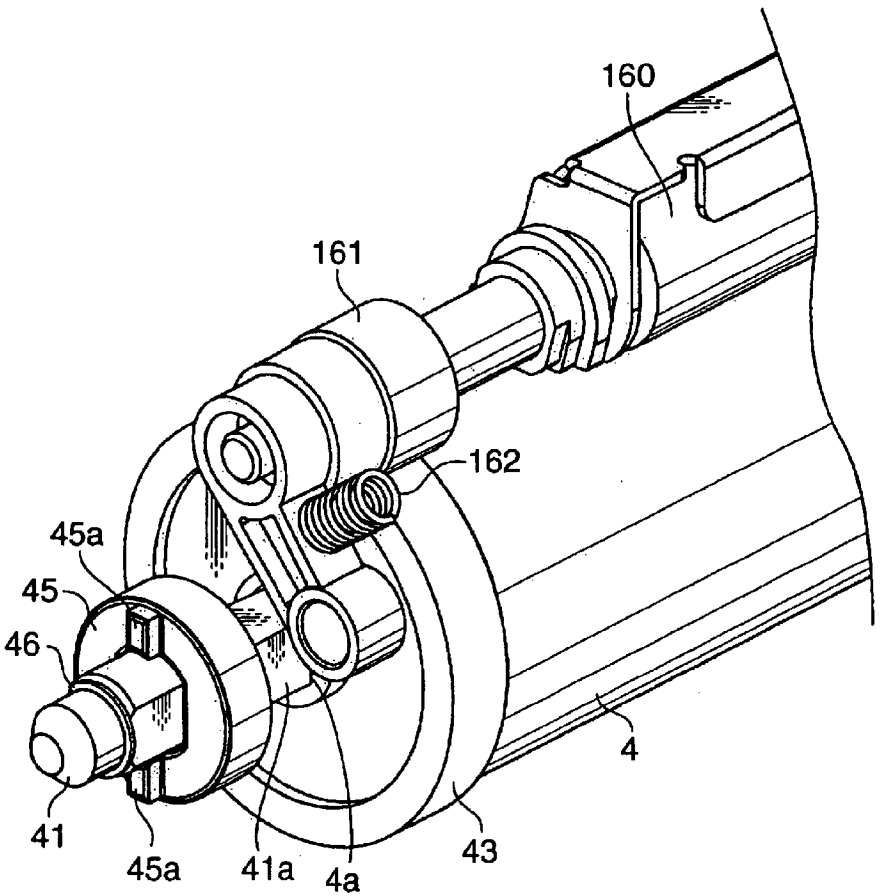
FIG. 4 is a perspective view of the portion same as that shown in FIG. 3, but viewed from a different direction from that viewed in FIG. 3.

With reference to FIGS. 3 and 4, description will be made in more detail about the structure of the jointed part where the lateral side of the rear end part 41*a* of the rotary shaft 41 is jointed to the rear end portion of the photosensitive drum 4, and the structure of the coupling member 45. FIG. 3 is a perspective view showing a state that the coupling member 45 is mounted on the rear end part 41*a* of the rotary shaft. FIG. 4 is a perspective view of the same portion as that shown to FIG. 3, but viewed from a direction different from that in FIG. 3. In FIGS. 3 and 4, the transfer roller 11 is not shown for the convenience of illustration.

The rear end part 41*a* of the rotary shaft 41 including the lateral side part at which the rotary shaft 41 is jointed to the photosensitive drum 4 has a non-circular shape in cross section. For instance, in this embodiment, as shown in FIGS. 3 and 4, the rear end part 41*a* has a substantially oval shape in cross section which is obtained by cutting away two opposing segments from a circle. The rear end portion of the photosensitive drum 4 at which the lateral side part of the rear end part 41*a* of the rotary shaft 41 is jointed to the photosensitive drum 4 is formed with a hole 4*a* having a contour corresponding to or complementary with the cross-sectional configuration of the rear end part 41*a*. When the rear end part 41*a* of the rotary shaft 41 is fitted in the hole 4*a* of the photosensitive drum 4, the rotary shaft 41 is jointed to the photosensitive drum 4 co-rotatably with each other. In this arrangement, when a rotating force of the drum motor is transmitted to the rotary shaft 41, the photosensitive drum 4 jointed to the rotary shaft 41 in an co-rotatable state is rotated along with the rotary shaft 41.

As mentioned above, the rear end part 41*a* has such a cross-sectional configuration as to allow the rotary shaft 41 to be rotatably supported on the bearing 62. The rear end part 41*a* may have a tapered shape along the axial direction of the rotary shaft 41 such that a tip end of the rear end part 41*a* where the rotary shaft 41 is jointed to the driving joint 50 is smaller in cross-section than the lateral side part of the rear end part 41*a* where the rear end part 41*a* is fitted in the hole 4*a* in the rear end portion of the photosensitive drum 4. Similar to the rear end part 41*a*, the front-end part 41*b* of the rotary shaft 41 which protrudes out of the photosensitive drum 4 at the front side of the copier 1 has such a shape as to be rotatably supported on the corresponding bearing 62. However, the front end part 41*b* may have a circular shape in cross section, so far as the front end part 41*b* is rotatably supported on the bearing 62.

The rotary shaft 41 is jointed to the photosensitive drum 4 by, for example, being inserted into the hollow of the cylindrical photosensitive drum 4 from the front side of the copier 1, with the rear end part 41*a* being received in the hole 4*a* formed in the rear end wall of the photosensitive drum 4 at the rear side of the copier 1 where the drum gear 43 is in mesh with the cleaning roller gear 161 and the transfer roller gear 111. The hollow of the photosensitive drum 4 has such dimensions as to accommodate allow the axially intermediate part of the rotary shaft 41 having the largest cross section.

After the insertion of the rotary shaft 41 in the photosensitive drum 4 is completed, the coupling member 45 is mounted on the rear end part 41*a* of the rotary shaft 41 that protrudes out of the photosensitive drum 4 at the rear side of the copier 1. The coupling member 45 is formed with a hole 45*b* having a contour corresponding to the cross-sectional configuration of the rear end part 41*a* of the rotary shaft 41. The coupling member 45 is mounted on the rotary shaft 41 with the tip end of the rear end part 41*a* being received in the hole 45*b*. Since it is impossible for an operator to insert the rear end part 41*a* into the hole 4*a* of the photosensitive drum 4 after the coupling member 45 is mounted on the rotary shaft 41, the coupling member 45 is mounted on the rotary shaft 41 after the rotary shaft 41 is inserted in the photosensitive drum 4.

After the coupling member 45 is mounted on the rotary shaft 41, a stopper ring 46 is mounted on the rear end part 41*a* at a position closer to the tip end thereof and away from the portion of the rear end part 41*a* where the coupling member 45 is mounted. The stopper ring 46 may preferably be a C-ring as shown in FIGS. 3 and 4 in view of easy and secure mounting, for the following reason. When the C-ring is mounted on the on the rear end part 41*a*, with the C-ring fitting a circular groove formed on the rear end part 41*a*, the peripheral part of the C-shaped stopper ring 46 is radially exposed out of the circular groove with the exposed part engaging the coupling member 45 to stop the axial movement of the latter, thereby keeping the coupling member 45 from falling off from the rotary shaft 41 (see FIG. 4).

As mentioned above, the rear end part 41*a* of the rotary shaft 41 has a function of keeping each of the photosensitive drum 4 and the coupling member 45 from rotating relative to the rotary shaft 41. With this arrangement, the photosensitive drum 4 and the coupling member 45 are securely rotated along with the rotary shaft 41.

The coupling member 45 is larger in cross section than the rotary shaft 41, and is designed to be in contact with the coupling member 45 with a larger area for the contact with the driving joint 50 (see FIG. 2) as compared with a case where the driving joint 50 is directly connected to the rotary shaft 41 without the coupling member 45 interposed therebetween. With this arrangement, the coupling member 45 is securely jointed to the driving joint 50, and thus the rotating force of the drum motor is efficiently transmitted to the rotary shaft 41. Furthermore, as shown in FIGS. 3 and 4, a projection 45*a* is formed on the surface of the coupling member 45 on the side opposing the driving joint 50 at which the coupling member 45 is jointed to or interconnected with the driving joint 50. The projection 45*a* projects in the axial direction of the rotary shaft 41 toward the driving joint 50. The projection 45*a* is fitted in a recess 50*a*, which is described later, formed on the driving joint 50. Fitting of the projection 45*a* in the recess 50*a* provides secure rotation of the coupling member 45 along with the driving joint 50, thus ensuring transmission of the rotating force of the drum motor to the rotary shaft 41.

The cleaning roller 160 is rendered in pressing contact with the surface of the photosensitive drum 4 with a certain pressing force being exerted thereto by a compression spring 162. Thus, the cleaning roller gear 161 is in mesh with the drum gear 43 with a certain pressing force being applied thereto.

Figure 5:
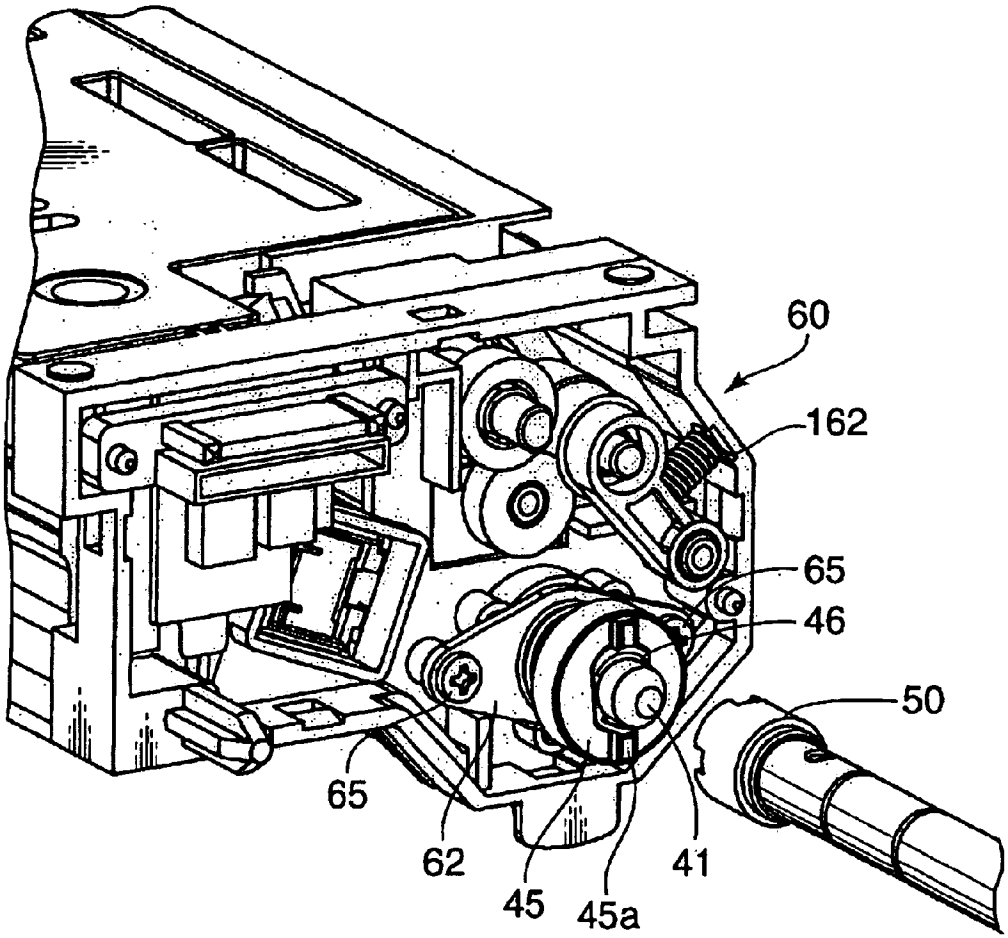
FIG. 5 is a partial perspective view of the image forming apparatus, showing a state that the photosensitive drum is mounted on a dram assembly.
Figure 6:
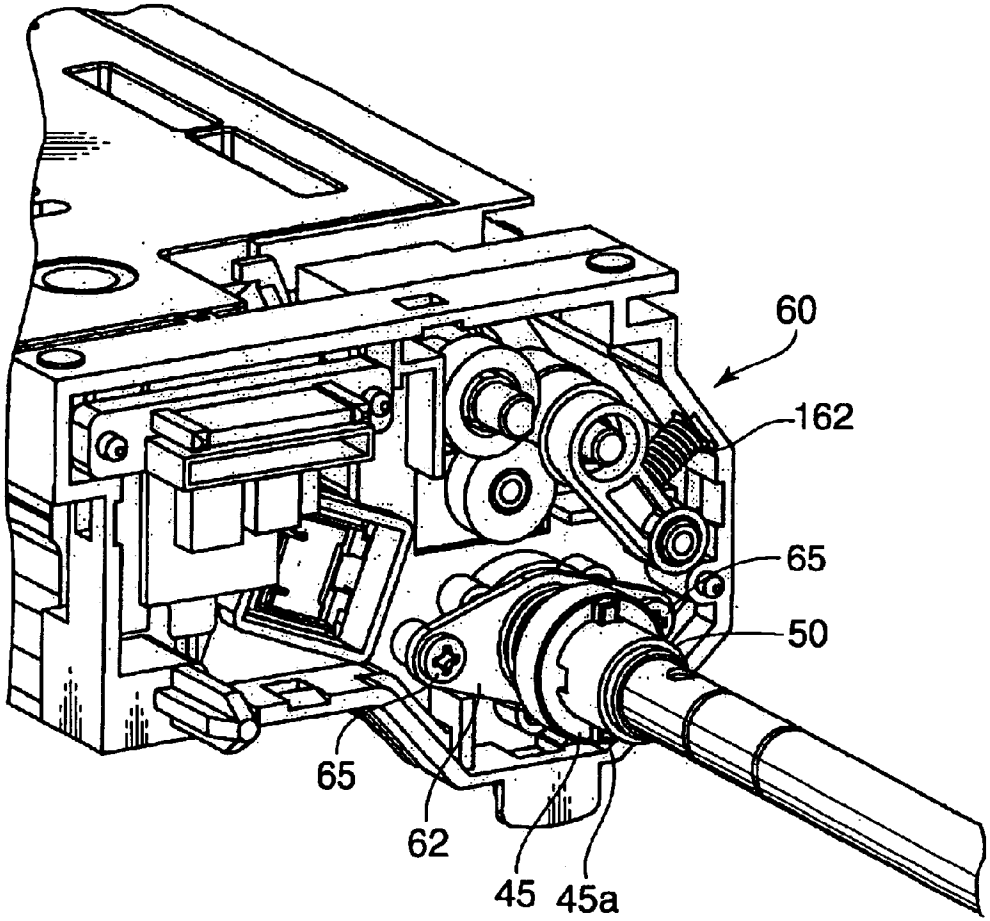
FIG. 6 is a perspective view of the image forming apparatus, showing a state that the photosensitive drum is mounted on the drum assembly with a driving joint being coupled to the coupling member.

FIG. 5 is a perspective view showing a state that the photosensitive drum 4 is mounted on the drum assembly 60. FIG. 6 is a perspective view showing a state that the photosensitive drum 4 is mounted on the drum assembly 60 after the driving joint 50 has been jointed to the coupling member 45. The photosensitive drum 4, the cleaning unit 16 including the cleaning roller 160, and a transfer unit including the transfer roller 11 are incorporated within the drum assembly 60. The rear end part 41*a* of the rotary shaft 41 is exposed out of the housing 61 of the drum assembly 60 at the rear side of the copier 1. In other words, when the photosensitive drum 4 is mounted in the drum assembly, the rear end part 41*a* of the rotary shaft 41 is protruded out of the drum assembly 60.

The rear end part 41*a* of the rotary shaft 41 projecting out of the drum assembly 60 is rotatably supported on the bearing (rear-side bearing) 62. At this stage, the coupling member 45 is positioned coaxially with the rotary shaft 41 with the rotary shaft 41 being supported on the rear-side bearing 62 and with the stopper ring 46 being mounted on the coupling member 45. As shown in FIG. 6, the projection 45*a* of the coupling member 45 which projects axially toward the driving joint 50 is fitted in the recess 50*a* of the driving joint 50 to joint the coupling member 45 with the driving joint 50. The rear-side bearing 62 is fixed to the housing 61 by screws 65 and 65, as shown in FIGS. 5 and 6.

Figure 7:
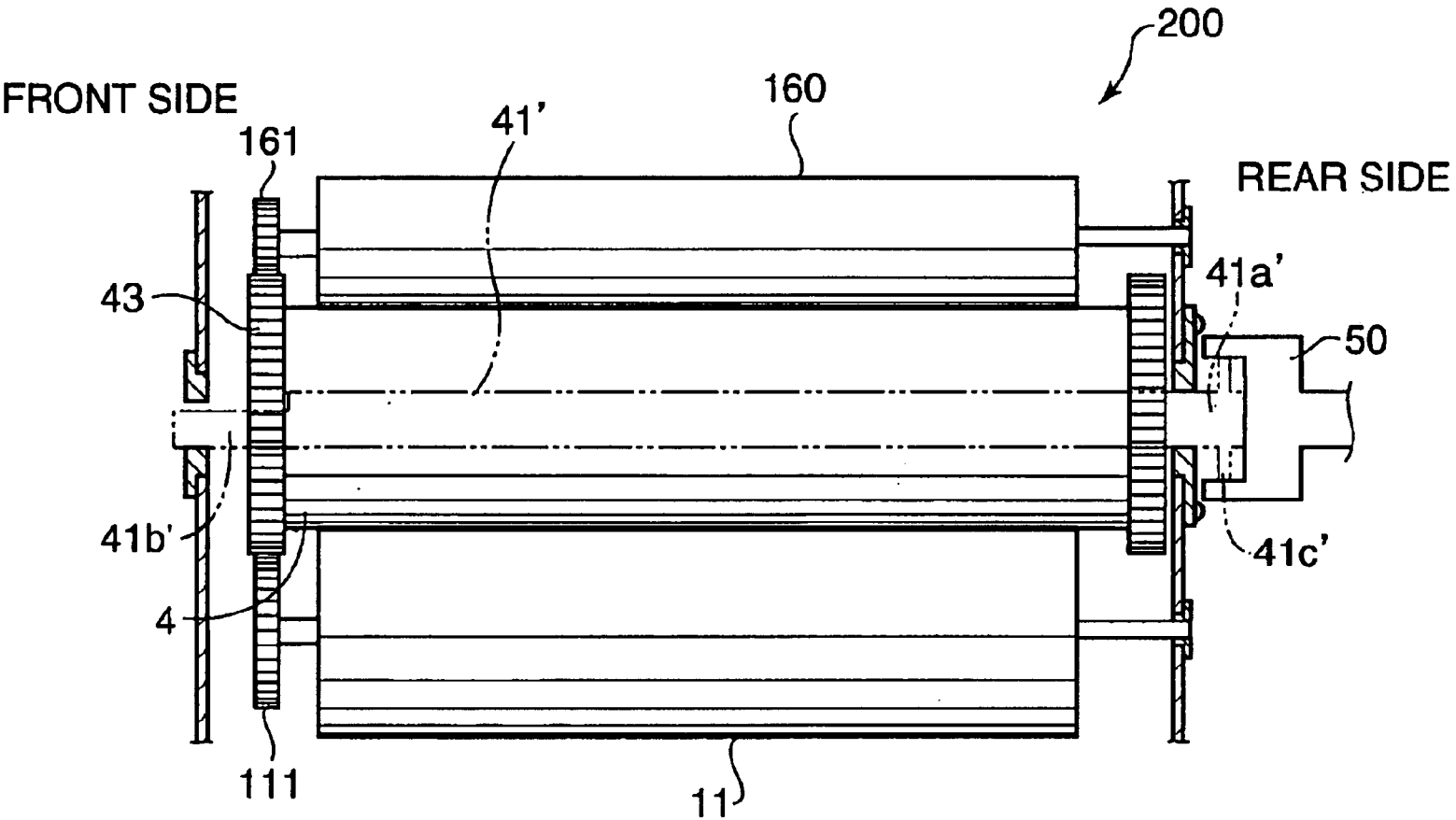
PRIOR ART FIG.7
FIG. 7 is a partial plan view showing a construction of a conventional driving mechanism.

As mentioned above, in the driving mechanism 100 of this embodiment, the photosensitive drum 4 is jointed to the rotary shaft 41 at the rear side of the photosensitive drum 4 where the drum gear 43 is in mesh with the cleaning roller gear 161 and the transfer roller gear 111 and where the driving joint 50 is jointed to the rotary shaft 41. This arrangement shortens a transmission route along which a rotating force of the drum motor is transmitted to the photosensitive drum 4, the cleaning roller 160 and the transfer roller 11, as compared with the conventional arrangement as shown in FIG. 7 where the rotating force of the drum motor is transmitted from one axial end of the rotary shaft 41' to the opposite axial end thereof before the rotating force is transmitted to the cleaning roller 160 and to the transfer roller 11. The above arrangement of this embodiment is free from torsional stress which is likely to be caused in the rotary shaft during transmission of a rotating force of the drum motor in the case where the conventional arrangement is adopted.

Furthermore, since the mass of the rotary shaft 41 is set equal to or larger than that of the photosensitive drum 4 in this embodiment, desirable image formation is performed by effectively suppressing occurrence of fluctuated rotation of the photosensitive drum, which is unavoidable in the conventional arrangement due to torsional stress exerted to the rotary shaft and the photosensitive drum.

Also, since the coupling member 45 is larger in cross section than the rear end part 41*a* of the rotary shaft 41, the rotating force of the drum motor is securely transmitted to the rotary shaft 41 via the driving joint 50.

Further, in the above embodiment, since the coupling member 45 is prepared independently of the rotary shaft 41, and is mounted on the rotary shaft 41 after the insertion of the rotary shaft 41 into the photosensitive drum 4, this arrangement enables an operator to easily access the copier 1 to insert the rotary shaft 41 into the hollow of the cylindrical photosensitive drum 4 from the front side of the copier 1 (namely, the side opposite to the rear side of the copier 1 where the driving joint 50 is provided) axially toward the driving joint 50 for the assembly of the drum unit 60.

It should be appreciated that this invention is not limited to the foregoing embodiment, and various modifications and alterations are applicable without departing from the scope and spirit of the invention as defined by attached claims. Followings are examples of such modifications or alternations.

(1) In the above embodiment, the lateral side part of the rear end part 41*a* of the rotary shaft 41 to be jointed to the photosensitive drum 4 has a substantially oval shape in cross section. As far as the rotary shaft 41 is rendered in a co-rotatable with the photosensitive drum 4, the cross-sectional configuration of the lateral side part (rear end part 41*a*) of the rotary shaft 41 is not limited to the one shown in the embodiment. For instance, the rotary shaft 41 may have a D-shape in cross section or its equivalent so far as the shape ensure the co-rotation and the radial bearing.

(2) As far as the rear end part 41*a* has a cross section smaller than the remaining part of the rotary shaft 41, the cross-sectional configuration of the rear end part 41*a* is not limited to the one shown in the embodiment.

(3) In the above embodiment, the driving mechanism 100 has a structure that a rotating force of the drum motor is transmitted via the photosensitive drum 4 to the cleaning roller 160 and the transfer roller 11. Alternatively, as far as the driving mechanism is so configured as to transmit a rotating force of the drum motor to a rotary member provided in the vicinity of the photosensitive drum 4 via the photosensitive drum 4, the rotary member may include one or more members other than the cleaning roller 160 and the transfer roller 11.

(4) Although the embodiment has been described with reference to a copier, the present invention is applicable not only to the copier but other types of image forming apparatus such as a laser bean printer and facsimile machine so far as they have a cylindrical photosensitive member and its associated roller.

This application is based on Japanese patent application No. 2001-396798 filed on Dec. 27, 2001, the contents of which are hereby incorporated by references.

As this invention may be embodied in several forms without departing from the spirit of essential characteristics thereof, the present embodiment is therefore illustrative an not restrictive, since the scope of the invention is defined by the appended claims rather than by the description preceding them, and all changes that fall within metes and bounds of the claims, or equivalence of such metes and bounds are therefore intended to embraced by the claims.

What is claimed is:

1. A driving mechanism for use in an image forming apparatus for driving a photosensitive member having a substantially cylindrical shape and a rotary member provided in the vicinity of the photosensitive member, the driving mechanism is to be interconnected with a driving motor to be driven thereby, the driving mechanism comprising:

a rotary shaft extending through the photosensitive member in a longitudinal direction of the photosensitive member and protruding from the photosensitive member at its opposite ends, the rotary shaft being journaled at its axially opposite ends by bearings, and being co-rotatably coupled with the photosensitive member at one of the axially opposite ends thereof, the rotary shaft having a mass larger than that of the photosensitive member;

a driving force transmission member which is jointed to the rotary shaft protruding from the photosensitive member at the one of the axial opposite ends, to transmit a driving force of the driving motor to the rotary shaft;

a photosensitive member gear provided at the one of the axial opposite ends of the photosensitive member to co-rotate with the photosensitive member; and a rotary member gear provided at the one of the axial opposite ends of the rotary member, the rotary member gear being in meshing engagement with the photosensitive member gear to be driven thereby.

2. The driving mechanism according to claim 1, wherein the photosensitive member has an end wall at the one axial end thereof, the end wall has a hole, the rotary shaft has an axial end part at the one axial end of the photosensitive member having a cross section which is smaller than a cross section of a portion of the rotary shaft within the photosensitive member, the axial end part of the rotary shaft passing through the hole of the end wall.

3. The driving mechanism according to claim 1, wherein the rotary shaft has an end part at each of its axially opposite ends, further comprising a coupling member co-rotatably coupled with the one of the axial ends of the rotary shaft outside of the photosensitive member, the coupling member being larger in a cross section than the one axial end part of the rotary shaft, and the driving force transmission device is jointed to the coupling member to transmit the driving force of the motor to the rotary shaft through the coupling member.

4. The driving mechanism according to claim 3, wherein an engaging portion is formed on the coupling member at a surface thereof opposing the driving force transmission device, and an engaged portion is formed on the driving force transmission device at a surface thereof opposing the coupling member, the engaging portion of the coupling member being adapted to fit in the engaged portion of the driving force transmission device.

5. The driving mechanism according to claim 4, wherein the one axial end part of the rotary shaft has a cross-sectional shape which is obtained by cutting away a segment from a circle; and holes are formed in the axial end portion of the photosensitive member and in the coupling member, the holes having such a contour as to match the cross-sectional shape of the one axial end part of the rotary shaft such that the one axial end part of the rotary shaft extends through the holes, and that the rotary shaft is co-rotatably coupled with the photosensitive member and the coupling member.

6. The driving mechanism according to claim 5, wherein the photosensitive member has an opening on the other of the axial ends to allow insertion of the rotary shaft therethrough.

7. An image forming apparatus comprising:

a photosensitive member having a substantially cylindrical shape;

a rotary member provided in the vicinity of the photosensitive member;

a driving motor for driving the photosensitive member and the rotary member;

a rotary shaft extending through the photosensitive member in a longitudinal direction of the photosensitive member and protruding from the photosensitive member at its opposite ends, the rotary shaft being journaled at its axially opposite ends by bearings, and being co-rotatably coupled with the photosensitive member at one of the axially opposite ends thereof, the rotary shaft having a mass larger than that of the photosensitive member;

a driving force transmission member which is jointed to the rotary shaft protruding from the photosensitive member at the one of the axial opposite ends, to transmit a driving force of the driving motor to the rotary shaft;

a photosensitive member gear provided at the one of the axial opposite ends of the photosensitive member to co-rotate with the photosensitive member; and a rotary member gear provided at the one of the axial opposite ends of the rotary member, the rotary member gear being in meshing engagement with the photosensitive member gear to be driven thereby.

8. An image forming apparatus according to claim 7, wherein the rotary shaft has an end part at each of its axially opposite ends, further comprising a coupling member co-rotatably coupled with the one of the axial ends of the rotary shaft outside of the photosensitive member, the coupling member being larger in a cross section than the one axial end part of the rotary shaft, and the driving force transmission device is jointed to the coupling member to transmit the driving force of the motor to the rotary shaft through the coupling member.

9. An image forming apparatus according to claim 8, wherein an engaging portion is formed on the coupling member at a surface thereof opposing the driving force transmission device, and an engaged portion is formed on the driving force transmission device at a surface thereof opposing the coupling member, the engaging portion of the coupling member being adapted to fit in the engaged portion of the driving force transmission device.

10. An image forming apparatus according to claim 8, wherein the one axial end part of the rotary shaft has a cross-sectional shape which is obtained by cutting away a pair of opposing segments from a circle.

11. The driving mechanism according to claim 1, wherein the rotary shaft has an axial end part at the one of the axial opposite ends of the photosensitive member, the axial end part of the rotary shaft having a cross section which is smaller than a cross section of a portion of the rotary shaft within the photosensitive member.

12. An image forming apparatus, comprising:

a photosensitive member having a substantially cylindrical shape and first and second axially opposite ends;

a rotary member arranged proximate to and rotatably coupled to said photosensitive member; and driving means for driving said photosensitive member and said rotary member, said driving means comprising:

a driving motor for providing a driving force; and a rotary shaft for receiving said driving force extending entirely through said photosensitive member in a longitudinal direction of said photosensitive member such that a first axial end of said rotary shaft protrudes from said first end of said photosensitive member and a second end of said rotary shaft axially opposite to said first end of said rotary shaft protrudes from said second end of said photosensitive member, said rotary shaft being rotatably supported, and said rotary shaft being co-rotatably coupled with said photosensitive member at said first end of said photosensitive member, said rotary shaft having a mass equal to or larger than a mass of said photosensitive member.

13. The image forming apparatus according to claim 12, wherein said photosensitive member has an end wall at said first axial end, said end wall having a hole, said rotary shaft having an axial end part at each of its first and second ends, a cross section of a first one of said axial end parts at said first end of said rotary shaft being smaller than a cross section of a portion of said rotary shaft within said photosensitive member, said first axial end part of said rotary shaft passing through said hole in said end wall.

14. The image forming apparatus according to claim 12, wherein:

said rotary shaft has a driving force transmission member jointed to said first end of said rotary shaft protruding from said first end of said photosensitive member to transmit a driving force of said driving motor to said rotary shaft; and said rotary shaft has an axial end part at each of its first and second ends, further comprising a coupling member co-rotatably coupled with said first end of said rotary shaft outside of said photosensitive member, said coupling member being larger in a cross section than said axial end part at said first end of said rotary shaft, and said driving force transmission device being jointed to said coupling member to transmit the driving force of said driving motor to said rotary shaft through said coupling member.

15. The image forming apparatus according to claim 14, wherein an engaging portion is formed on said coupling member at a surface thereof opposing said driving force transmission device, and an engaged portion is formed on said driving force transmission device at a surface thereof opposing said coupling member, said engaging portion of said coupling member being adapted to fit in said engaged portion of said driving force transmission device.

16. The image forming apparatus according to claim 15, wherein said axial end part at said first end of said rotary shaft has a cross-sectional shape which is obtained by cutting away a segment from a circle.

17. The image forming apparatus according to claim 16, wherein said photosensitive member includes an axial end portion having holes formed therein, said coupling member having holes formed therein, said holes having a contour matching the cross-sectional shape of said axial end part at said first end of said rotary shaft such that said axial end part at said first end of said rotary shaft extends through said holes, and said rotary shaft being co-rotatably coupled with said photosensitive member and said coupling member.

18. The image forming apparatus according to claim 17, wherein said photosensitive member has an opening at said second end to allow insertion of said rotary shaft therethrough.

19. The image forming apparatus according to claim 12, wherein said rotary shaft has an axial end part at each of its first and second ends, a cross section of said axial end part at said first end of said rotary shaft being smaller than a cross section of a portion of said rotary shaft within said photosensitive member.

20. The image forming apparatus of claim 12 further comprising:

a photosensitive member gear arranged at said first end of said photosensitive member to co-rotate with said photosensitive member; and a rotary member gear arranged at said first end of said rotary member, said rotary member gear being in meshing engagement with said photosensitive member gear to be driven thereby.

* * * * *